US006830480B2

(12) United States Patent
Yoshioka

(10) Patent No.: US 6,830,480 B2
(45) Date of Patent: Dec. 14, 2004

(54) SHIELDING CONNECTOR

(75) Inventor: Chikahiro Yoshioka, Nagoya (JP)

(73) Assignees: Sumitomo Wiring Systems, Ltd., Mie (JP); Autonetworks Technologies, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/241,514

(22) Filed: Sep. 12, 2002

(65) Prior Publication Data

US 2003/0049966 A1 Mar. 13, 2003

(30) Foreign Application Priority Data

Sep. 13, 2001 (JP) ..... 2001-278374

(51) Int. Cl.[7] ..... H01R 13/648
(52) U.S. Cl. ..... 439/610; 439/607
(58) Field of Search ..... 439/607, 610, 439/98, 106, 701, 594, 717, 696, 687, 731, 871, 585, 171; 174/35 C

(56) References Cited

U.S. PATENT DOCUMENTS

| | | | | | |
|---|---|---|---|---|---|
| 3,958,851 | A | * | 5/1976 | Evans | 439/295 |
| 4,269,469 | A | | 5/1981 | Audic | |
| 4,653,825 | A | * | 3/1987 | Olsson | 439/607 |
| 5,055,063 | A | | 10/1991 | Sato | |
| 5,180,316 | A | * | 1/1993 | Miller et al. | 439/610 |
| 5,184,965 | A | * | 2/1993 | Myschik et al. | 439/607 |
| 5,529,506 | A | | 6/1996 | Onoda | |
| 5,632,634 | A | * | 5/1997 | Soes | 439/731 |
| 5,639,262 | A | * | 6/1997 | Lim | 439/607 |
| 5,975,950 | A | * | 11/1999 | Yamaguchi | 439/610 |
| 6,039,606 | A | * | 3/2000 | Chiou | 439/610 |
| 6,083,048 | A | | 7/2000 | Yamaguchi | |
| 6,390,852 | B1 | * | 5/2002 | Wang | 439/610 |
| 6,471,547 | B1 | * | 10/2002 | Venaleck et al. | 439/608 |
| 6,524,135 | B1 | * | 2/2003 | Feldman et al. | 439/610 |

FOREIGN PATENT DOCUMENTS

| | | |
|---|---|---|
| DE | 41 16 168 A1 | 1/1993 |
| EP | 0 981 180 A1 | 2/2000 |

* cited by examiner

*Primary Examiner*—Dean A. Richard
*Assistant Examiner*—Angel R Estrada
(74) *Attorney, Agent, or Firm*—Oliff & Berridge, PLC

(57) ABSTRACT

Disclosed is a shielding connector 20 having inner conductor terminals 30 to which terminal parts of core wires 11 of a shielded cable 10, a dielectric body 50 for receiving the inner conductor terminals 30, and a shielding shell 60 installed around the dielectric body 50. In the shielding connector, an insulating plate 56 for suppressing an impedance variation caused by a variation of a cross sectional configuration of a signal transmission line, which results from the exposure of the terminal parts of the core wires 11, is interposed between the terminal parts of the core wires 11 connected to the inner conductor terminals 30 and a inner bottom surface of the shielding shell 60 put around the dielectric body 50.

2 Claims, 5 Drawing Sheets

SHIELDING CONNECTOR

BACKGROUND OF THE INVENTION

The present invention relates to a shielding connector, and more particularly to a shielding connector including a dielectric body which receives inner conductor terminals connected to core-wire terminal parts of a shielded cable, and a shielding shell applied to the outer periphery of the dielectric body.

A conventional shielding connector 110 is constructed as shown in FIGS. 4 and 5. In a shielded cable 100, core wires 101 each including a conductor 101*a* covered with an insulating layer 101*b*, and a drain wire 102 including a plurality of twisted steel element wires are covered with a metal foil 103. The outer periphery of the metal foil is covered with an insulating covering 104. The core wires 101 and the drain wire 102 are expose at a terminal part of the shielded cable 100. The terminal parts of those exposed wires, the core wires 101 and the drain wire 102, are connected to an inner conductor terminal 120 and a drain terminal 130, respectively. The inner conductor terminal 120 and the drain terminal 130 are placed in a terminal receptacle 141 of a dielectric body 140. A metal shielding shell 150 electrically conductively connected to the drain terminal 130 is applied to the outer periphery of the dielectric body 140.

As seen from FIG. 5 showing a cross sectional view taken on line A—A in FIG. 4, the shielded cable 100 is connected to the shielding connector 110 in the following manner. The inner conductor terminals 120 and the drain terminal 130 are first put in the terminal receptacle 141 of the dielectric body 140. Then, the shielding shell 150 is set around the dielectric body to thereby assemble the shielding connector 110. The exposed core wires 101 of the shielded cable 100 are press connected to press-connection blades 121L and 121R, which stand erect, while being opposed, in a rear part of the inner conductor terminal 120. The drain wire 102 is press connected to press-connection blades 131L and 131R, and 132L and 132R, which stand erect, while being opposed, in a rear part of the drain terminal 130 (the drain wire and the drain terminal are not directly shown, but are parenthesized in the figure). The terminal part of the insulating covering 104 of the shielded cable 100 is adhesively held with insulating barrels 151L and 151R provided at the rear end of the shielding shell 150.

To connect the shielded cable containing a plurality of core wires (inclusive of the drain wire) to the shielding connector, as shown in FIG. 4, the core wire located closer to the outer side of the cable must be bent to position the wire at its connection position to the inner conductor terminal. To this end, such a distance as to allow the core wire to bend must be secured over a range from the base part of the core wire to the connection part. As a result, as shown in FIG. 5, a gap (space) C is present between the terminal parts of the exposed core wires and the inner bottom surface of the shielding shell.

In a state that the core wires are not exposed, a part of each core wire shielded by the metal foil serves as a signal transmission line. When the metal foil is peeled off parts of the core wires to expose those parts, a signal leaks from the exposed parts of the core wires, viz., a cross sectional configuration of the signal transmission line, varies. If a space is present between the exposed parts of the core wires and the inner bottom surface of the shielding shell, a cross sectional configuration of the signal transmission line is greatly varied correspondingly. As a result, a value shift of impedance occurs between the exposed part of the core wire and the not exposed part of the core wire. In the shielding connector used as a high speed signal transmission interface, such as USB (universal serial bus) and IEEE1394, if such an impedance shift occurs, an abnormal signal or noise is generated at the impedance mismatching part, possibly resulting in an system error or the like. For this reason, an exact impedance matching is required between the interface and the printed circuit board (PCB).

SUMMARY OF THE INVENTION

Accordingly, an object of the present invention is to provide a shielding connector which reduces an impedance variation (value shift) appearing between the exposed terminal parts of the core wires of the shielded cable, which are at the connection part of the shielded cable to the shielding connector, and the not exposed part of the shielded cable, the impedance variation being due to a variation of the cross sectional configuration of the signal transmission line, thereby improving a reliability of the signal transmission line.

According to the present invention, there is provided a shielding connector having inner conductor terminals to which terminal parts of core wires of a shielded cable, a dielectric body for receiving the inner conductor terminals, and a shielding shell installed around the dielectric body, wherein an insulating plate for suppressing an impedance variation caused by a variation of a cross sectional configuration of a signal transmission line, which results from the exposure of the terminal parts of the core wires, is interposed between the terminal parts of the core wires connected to the inner conductor terminals and a inner bottom surface of the shielding shell put around the dielectric body.

In the shielding connector thus constructed, the insulating plate is located in a space present between the exposed core wires connected to the inner conductor terminals and an inner bottom surface of the shielding shell. With provision of the dielectric body, the space is reduced, and hence, a variation of a cross sectional configuration of the exposed parts of the core wires as a signal transmission line is reduced. As a result, an impedance variation within the shielding connector is reduced. And generation of abnormal signals and noise when signals are transmitted is effectively suppressed.

The insulating plate is interposed between the exposed parts of the core wires and the inner bottom surface of the shielding shell. With this feature, if the insulating covering of the core wire is broken by some cause and the conductor of the core wire is exposed, there is no chance that the exposed conductor comes in contact with the shielding shell and shortcircuiting occurs therebetween. As a result, a stable connection state is ensured between the shielded cable and the shielding connector.

The insulating plate is preferably provided integrally with the dielectric body. If the insulating plate is so formed, the number of required parts and the number of production process steps are reduced. Therefore, the efficiency of producing the whole shielding connector is improved.

BRIEF DESCRIPTION OF THE DRAWINGS

FIG. 3 is a cross sectional view taken on line A—A in FIG. 2 showing how to connect the terminal part of a shielded cable to the assembly of the FIG. 1 shielding connector.

FIG. 5 is a cross sectional view taken on line A—A in FIG. 4 showing how to connect the terminal part of the shielded cable to the conventional shielding connector.

DETAILED DESCRIPTION OF THE PREFERRED EMBODIMENTS

Figure 1:
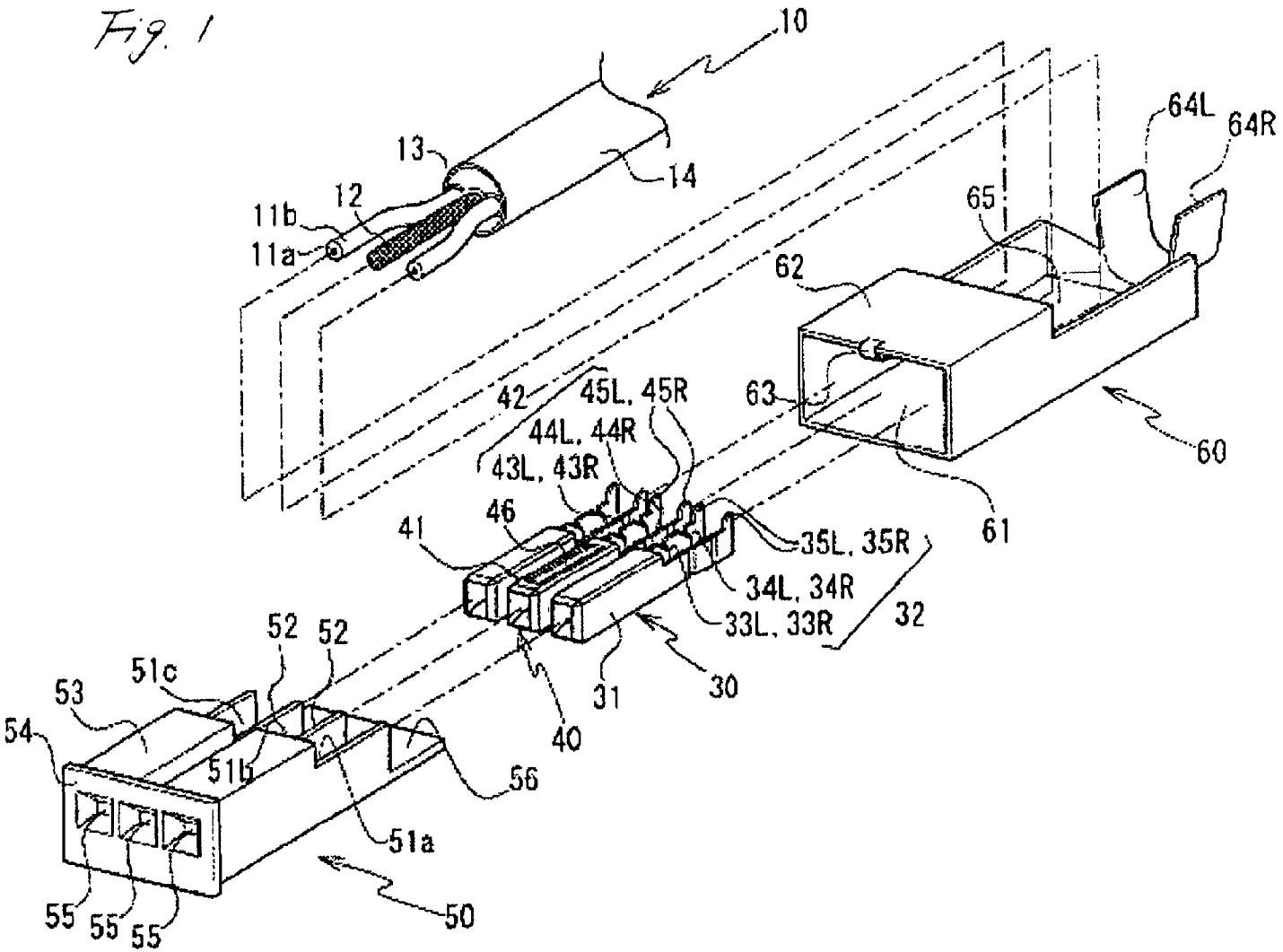
FIG. 1 is an exploded perspective view showing a shielding connector which is an embodiment of the present invention.
Figure 2:
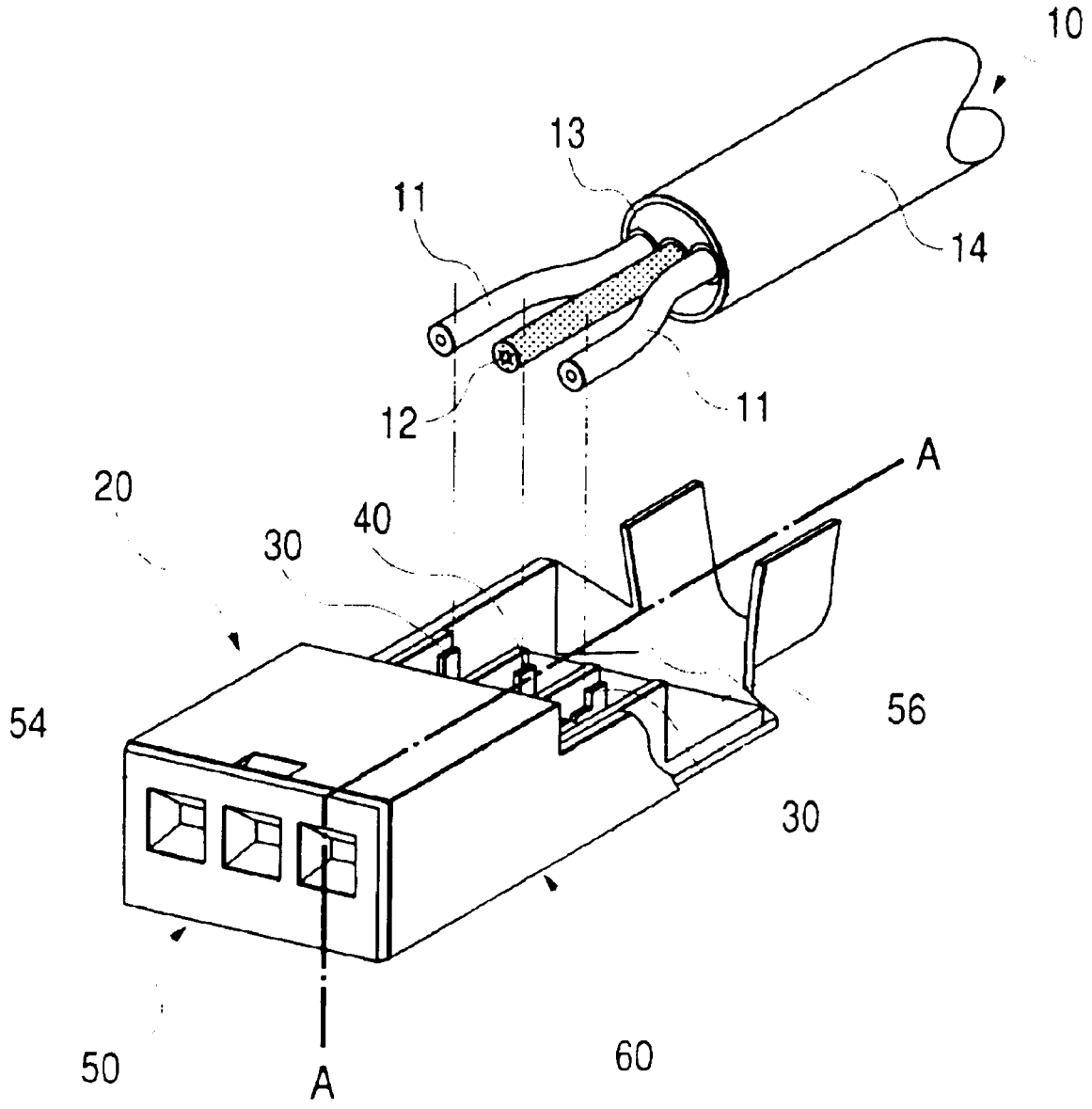
FIG. 2 is a perspective view showing how to connect the terminal part of a shielded cable to the assembly of the FIG. 1 shielding connector.

A shielding connector which is an embodiment of the present invention will be described in detail with reference to FIGS. 1 to 3. FIG. 1 is an exploded, perspective view showing a shielding connector which is an embodiment of the present invention. A shielded cable 10 to be connected to a shielding connector 20 includes core wires 11 each including a conductor 11*a* covered with an insulating layer 11*b*, and a drain wire 12 including a plurality of twisted copper element wires. The core wires 11 and the drain wire 12 are covered with a metal foil 13. The outer periphery of the metal foil 13 is further covered with an insulating covering 14.

The shielded cable 20 is formed with inner conductor terminals 30 to which the terminal parts of the core wires 11 are to be connected, a, drain terminal 40 to which a terminal part of the drain wire 12 is connected, a dielectric body 50 for receiving the inner conductor terminals 30 and the drain terminal 40, and a shielding shell 60 which is applied to the outer periphery of the dielectric body 50 and brought into conductive contact with the drain terminal 40.

The inner conductor terminals 30 are of the female type, and each of the inner conductor terminals is formed of a terminal fitting part 31 to which a male terminal of the counter connector is fit, and a cable connection part 32 to which each terminal part of the shielded cable 10 is connected. Two sets of press contact blades 33L, 33R, and 34L, 34R, while each set being opposed to each other, stand upright on both side walls of the cable connection part 32. Those press contact blades are used for the press connection to the exposed core wire 11. Core wire barrels 35L and 35R for press connecting and holding the core wires 11 are provided in a rear part of the press connection blades.

The drain terminal 40 is also of the male type, and receives a (male) terminal of the counter connector, and includes a contact part 41 to be in conductive contact with the shielding shell 60 to be described later. Two sets of press contact blades 43L, 43R and 44L, 44R are vertically erect on the rear side of the contact part 41, while each set of the press contact blades are opposed to each other. A drain-wire connection part 42 provided with drain wire barrels 45L and 45R is provided in a rear pat of the press contact blades. The drain wire barrels 45L and 45R clamp the press connected drain wire 102. A rectangular engaging recess 46 is formed in the upper surface of the contact part 41. A conductive contact piece 63 provided on the shielding shell 60 to be described later is brought into engagement with the engaging recess.

The dielectric body 50 is made of dielectric insulating resin, and includes terminal receptacles 51*a*, 51*b*, and 51*c* for receiving the inner conductor terminals 30 and the drain terminal 40. The receptacles are partitioned from one another by upstanding partitioning plates 52. Parts of the terminal receptacles 51*a* and 51*c* in which the terminal fitting parts 31 are to be placed are covered with an upper surface part 62. A conductive contact piece of the shielding shell 60 to be described later is inserted into the receptacle 51*b* of the drain terminal 40. An upper surface part 53 is opened to have an opening of a fixed width for the conductive connection to the contact part 41 of the drain terminal 40.

A flange part 54 having terminal insertion holes 55 is provided on the front surface of the dielectric body 50. Terminals of the counter connector are inserted into those terminal insertion holes 55. A planar insulating plate 56 is provided at the rear end edges of the terminal receptacles 51*a*, 51*b,* and 51*c*. The insulating plate 56 is formed such that its upper surface is substantially in level wit the inner bottom surface of the terminal receptacles or somewhat lower than the latter. As shown in FIG. 3, a fitting recess 57 is formed in the inner bottom surface of the dielectric body 50. A fitting piece 66 provided on the inner bottom surface 65 of the shielding shell 60 to be described later is to be fit into the fitting recess.

The shielding shell 60 includes an insertion opening 61 at one end thereof. The dielectric body 50 is inserted into the shell, through the insertion opening. The upper surface of the insertion opening 61 is defined by the upper surface part 62 for completely covering the upper surface part 53 of the dielectric body 50. The flexible, conductive contact piece 63 is provided, while being bent, on the end edge of the insertion opening 61. The conductive contact piece is to be brought into conductive contact with the drain terminal 40. A pair of insulating barrels 64L and 64R, while being opposed to each other, stand erect on the rear side of the shielding shell 60. The paired insulating barrels are provided for holding the periphery surface of the insulating covering 14 of the shielded cable 10. As shown FIG. 3, the inner bottom surface 65 of the shielding shell 60 is cut and raised toward the connection side of the shielded cable 10 to thereby form the fitting piece 66 which will be brought into engagement with the fitting recess 57 formed in the inner bottom surface of the dielectric body 50.

How to connect the terminal part of the shielded cable 10 to the shielding connector 20 will be described. As shown in FIGS. 2 and FIG. 3 showing a cross sectional view, taken on line A—A in FIG. 2, to start with, the inner conductor terminal 30 an the drain terminal 40 are inserted into the terminal receptacles 51*a*, 51*b*, and 51*c*. Then, the dielectric body 50 is inserted into the shielding shell 60 through the insertion opening 61 thereof till the flange part 54 is stopped at the end edge of the shielding shell 60, which is closer to the insertion opening. Thus, the flange part 54 is stopped at the end edge of the shielding shell 60, and at the same time, the fitting piece 66 formed on the inner bottom surface 65 of the shielding shell 60 is fit into the fitting recess 57 formed in the inner bottom surface of the dielectric body 50. As a result, the dielectric body 50 is immovable in both the pushing-in and the pulling-out directions within the shielding shell 60.

When the dielectric body 50 is stopped with in the shielding shell 60, the conductive contact piece 63 provided at the end edge of the upper surface part 62 of the shielding shell 60 is brought into engagement with the engaging recess 46 formed in the upper surface of the contact part 41 of the drain terminal 40, through a gap formed in the upper surface part 53 of the terminal receptacle 51*b*. As a result, the shielding shell 60 is brought into conductive contact with the drain terminal 40.

The core wire 11 and the drain wire 12,are exposed at the terminal part of the shielded cable 10, and then those exposed ones are connected to the inner conductor terminal 30 and drain terminal 40 of the shielding connector 20 thus assembled. The terminal part of the core wire 11 is connected to the inner conductor terminal 30 in a manner that the core wire 11 is pressed on the press contact blades 33L, 33R and 34L, 34R from above, and the press connected terminal part of the core wire 11 is clamped with the core wire barrels 35L and 35R.

The drain wire 12 is connected to the drain terminal 40 in the following manner. The press connected terminal part of the drain wire is clamped with the drain wire barrels 45L and 45R, and weldering, soldering or another suitable fixing process is applied to the press connected part, if necessary (the drain terminal 40 is located at the inner part of the inner conductor terminal 30, and hence, it is not illustrated in FIG. 3 but its reference numeral is parenthesized.). Finally, the outer periphery of the insulating covering 14 is clamped with the insulating barrels 64L and 64R provided in the rear part of the shielding shell 60, whereby the connection of the terminal part of the shielded cable 10 to the shielding connector 20 is completed.

Figure 3A:
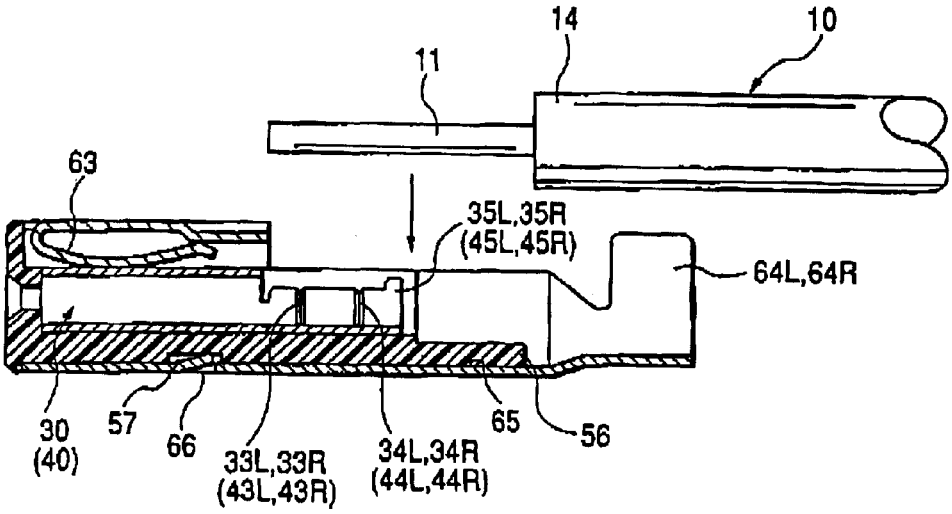
FIG. 3A is a cross sectional view showing a state of the terminal part and the assembly before those are connected.
Figure 3B:
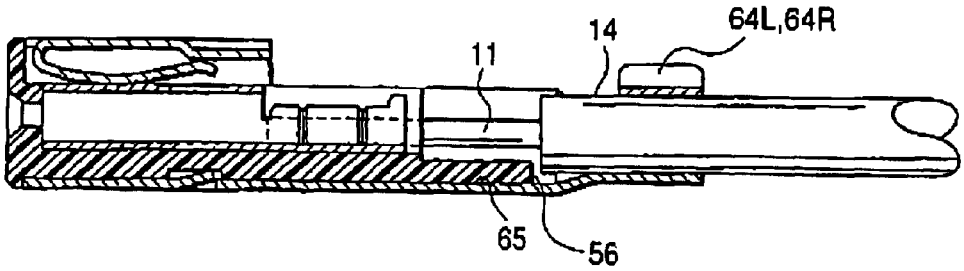
FIG. 3B is a cross sectional view showing a state of the terminal part and the assembly after those are connected.
Figure 4:
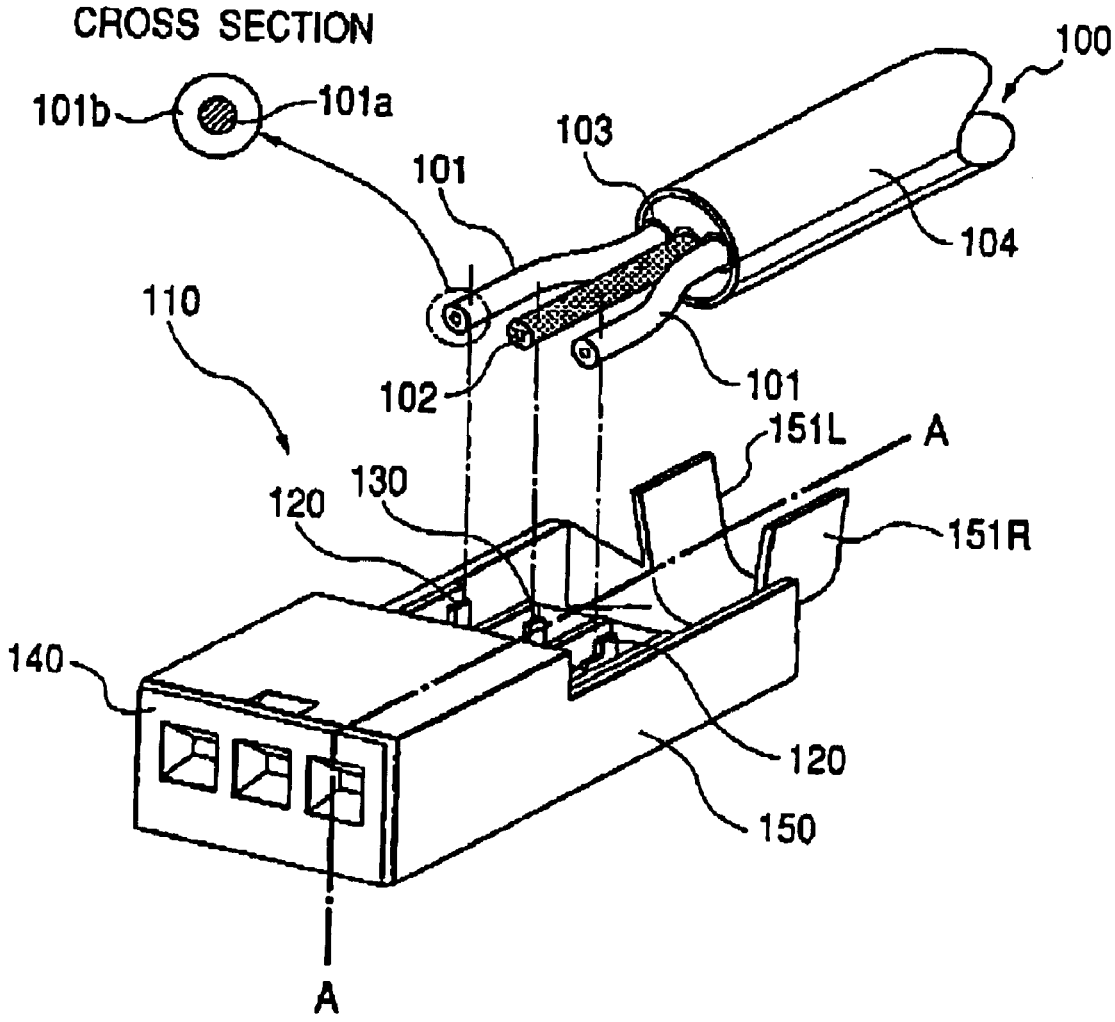
FIG. 4 PRIOR ART
FIG. 4 is a perspective view showing how to connect the terminal part of a shielded cable to a conventional shielding connector usually used.
Figure 5A:
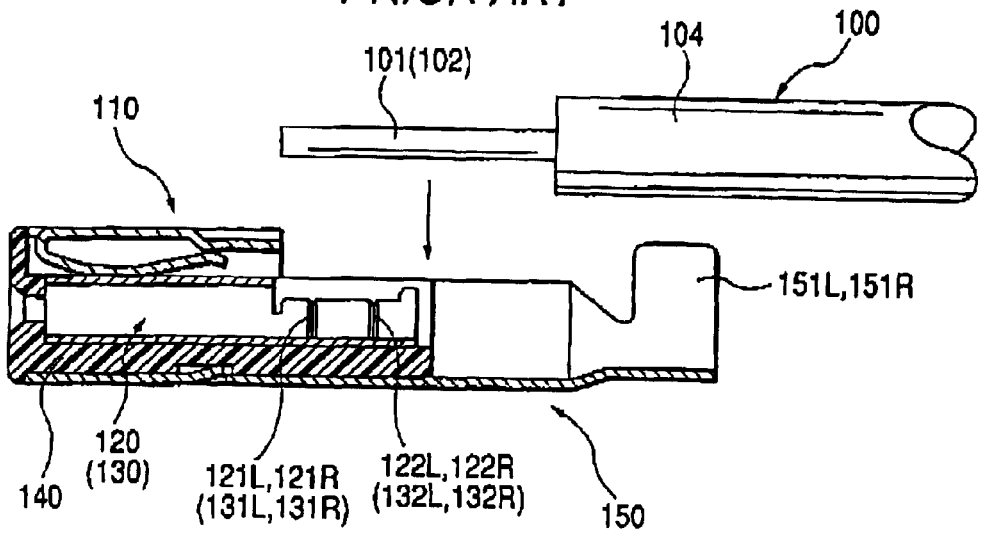
FIG. 5A PRIOR ART
FIG. 5A is a cross sectional view showing a state of the terminal part and the shielding connector before those are connected.
Figure 5B:
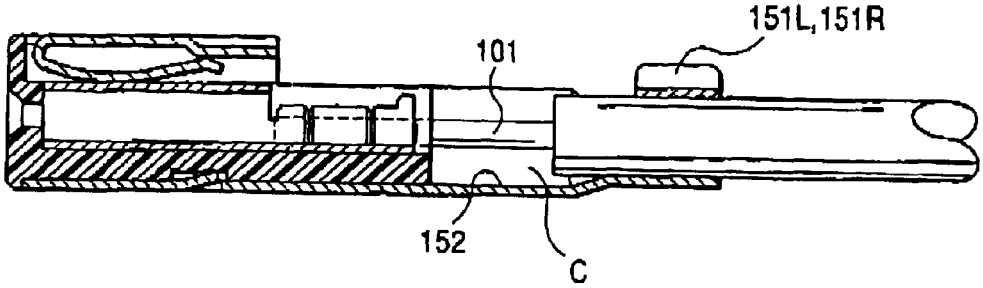
FIG. 5B PRIOR ART
FIG. 5B is a cross sectional view showing a state of the terminal part and the shielding connector after those are connected.

Since the shielding connector is constructed as mentioned above, the insulating plate 56 formed, integrally with the dielectric body 50, as shown in FIG. 3, is interposed between the terminal part of the core wire 11 connected to the inner conductor terminal 30 and the inner bottom surface 65 of the shielding shell 60. Accordingly, little space is present between them. A cross sectional configuration of the signal transmission line is little varied also at the exposed part of the core wire 11. Accordingly, the impedance shift within the shielding connector is minimized. Incidentally, to further reduce the space between the terminal part of the core wire 11 and the inner bottom surface 65 of the shielding shell 60, the position of the upper surface of the insulating plate 56 may further be lowered than the illustrated one.

Since the insulating plate 56 is interposed between the core wire 11 and the shielding shell 60, even if the insulating layer 11*b* of the core wire is broken by some cause and the conductor 11*a* is exposed, there is no chance that it is shortcircuited to the shielding shell 60, and hence, a stable connection state is ensured.

If the insulating layer 11*b* of the core wire connected to the inner conductor terminal is broken, the exposed conductor 11*a* comes in contact with the drain wire 12 located inside the conductors, resulting in shortcircuiting, or it comes in contact with the inner wall of the shielding shell 60, resulting in shortcircuiting. To prevent such shortcircuiting, the partitioning plates 52 for separating the core wire 11 from the drain wire 12, which are provided in the dielectric body 50, and the side wall of the dielectric body 50 may be extended to the upper surface of the insulating plate 56.

It should be understood that the present invention is not limited to the embodiment thus far described, but may variously be modified, altered and changed within true spirits and scope of the invention. In the embodiment described above, the insulating plate which is placed in the space present between the terminals of the exposed core wires of the shielded cable and the inner bottom surface of the shielding shell, is formed integrally with the dielectric body, while being located at the rear end of the dielectric body. The insulating plate may be formed separately from the dielectric body. Either in the case where the insulating plate is integral with the dielectric body or the case where those are separately formed, the configuration of the insulating plate may variously be modified according to a configuration of the shielding shell.

In the embodiment, the shielded cable connected to the shielding connector is of the type which includes core wires and the drain wire. The shielded cable maybe a shielded cable having a structure in which shielding braided wires are used instead of the drain wire, while surrounding the core wires. The number of core wires of the shielded cable is not limited to that in the embodiment, but may appropriately be selected.

It is evident that the shielding connector of the embodiment may be applied to the coaxial cable using a single core wire.

In the embodiment, to connect the terminal part of the shielded cable to the inner conductor terminal, the press-connection blades are provided in a rear part of the inner conductor terminal, and the exposed core wires are pressed against the press-connection blades. The following connection method may be employed if the situation demands it. A part of the insulating cover of the core wire is peeled off to expose the conductor thereof, and the exposed conductor is connected to the inner conductor terminal 30 by welding, soldering, or the like. In a case where the cable and the connector are satisfactorily reliably connected, the insulating barrels which are provided on the rear side of the shielding shell forming the shielding connector may be omitted. If those barrels are used, there is no need of providing the barrels integrally with the shielding shell, but those members may be provided separately.

As seen from the foregoing description, in the shielding connector of the invention, the insulating plate, which is provided integrally with or separately from the inner conductor terminals, is located in a space is present between the terminal parts of the exposed core wires which are electrically connected to the inner conductor terminals and the inner bottom surface of the shielding shell installed around the dielectric body which receives the inner conductor terminals. With such a structure, a variation of the cross sectional configuration of the signal transmission line at the terminal parts of the exposed core wires is reduced. Therefore, a variation of the impedance within the shielding connector is suppressed. As a result, even in the case where the shielding connector is used for the high signal transmission interface, such as USEB and IEEE1394, good impedance matching is secured. Accordingly, such useful effects of the invention as to successfully eliminate the system error caused by abnormal signals and noise are produced.

What is claimed is:

1. A shielding connector comprising:

inner conductor terminals to which terminal parts of core wires of a shielded cable, a dielectric body for receiving said inner conductor terminals, a shielding shell installed around said dielectric body, and an insulating plate for suppressing an impedance variation caused by a variation of a cross sectional configuration of a signal transmission line, which results from the exposure of said terminal parts of said core wires, being interposed between exposed portions of the terminal parts of said core wires connected to said inner conductor terminals and an inner bottom surface of said shielding shell put around said dielectric body.

2. The shielding connector according to claim 1, wherein said insulating plate is provided integrally with said dielectric body.

* * * * *